US005966111A

United States Patent [19]

Koshoubu et al.

[11] Patent Number: 5,966,111

[45] Date of Patent: Oct. 12, 1999

[54] MATRIX TYPE LIQUID CRYSTAL DISPLAY DEVICE

[75] Inventors: Nobuaki Koshoubu, Kariya; Masao Tokunaga, Gamagori, both of Japan

[73] Assignee: Denso Corporation, Kariya, Japan

[21] Appl. No.: 08/736,246

[22] Filed: Oct. 24, 1996

[30] Foreign Application Priority Data

Oct. 26, 1995 [JP] Japan ..... 7-279127

[51] Int. Cl.[6] ..... G09G 3/36

[52] U.S. Cl. ..... 345/94; 345/55

[58] Field of Search ..... 345/87, 88, 89, 345/90, 91, 92, 93, 94, 95, 96, 97, 98, 99, 100, 101, 102, 103, 104, 55.86; 349/1–2, 11, 14, 32, 33, 76, 83–85, 100–109

[56] References Cited

U.S. PATENT DOCUMENTS

| | | | |
|---|---|---|---|
| 4,915,477 | 4/1990 | Ohta et al. | 350/333 |
| 5,011,269 | 4/1991 | Wakita et al. | 350/350 |
| 5,117,298 | 5/1992 | Hirai | 359/55 |
| 5,400,048 | 3/1995 | Shimada et al. | 345/97 |
| 5,459,481 | 10/1995 | Tanaka et al. | 345/95 |
| 5,631,752 | 5/1997 | Tanaka | 349/173 |

FOREIGN PATENT DOCUMENTS

| | | |
|---|---|---|
| 558 060 | 9/1993 | European Pat. Off. . |
| 4-249290 | 9/1992 | Japan . |
| 4-311920 | 11/1992 | Japan . |
| 4-311921 | 11/1992 | Japan . |
| 5-210092 | 8/1993 | Japan . |
| 5-273941 | 10/1993 | Japan . |
| 5-307169 | 11/1993 | Japan . |
| 6-82760 | 3/1994 | Japan . |

OTHER PUBLICATIONS

Optronics (1994) No. 2pp. 58–61 Yamada et al, "Anti–Ferroelectric Liquid Crystal Medium Display".

*Primary Examiner*—Mark K. Zimmerman
*Assistant Examiner*—Thu Nguyen
*Attorney, Agent, or Firm*—Pillsbury Madison & Sutro LLP

[57] ABSTRACT

Burning and flickering effects of a display screen in a matrix-type liquid crystal display device using an anti-ferroelectric liquid crystal medium are avoided by controlling the duration of the holding period to a certain length. A control circuit measures the cycle of the input of the picture signals to one picture frame, and the duration of the blanking period is controlled according to the result of the measurement in order to keep the duration of the holding period constant.

17 Claims, 13 Drawing Sheets

Vwp
Vhp
Y1 Ve
Vhn
Vwn

Vwp
Vhp
Y2 Ve
Vhn
Vwn

Vwp
Vhp
Y3 Ve
Vhn
Vwn
Y1 -H B +S +H B -S -H
Y2 +H B -S -H B +S +H
Y3 -H B +S +H B -S -H

SCC

SIO1

SIO2

DP

Vsp
Xi Ve
Vsn
PIXEL DATA
L1 NL1
L2 NL2
L3 NL3
L4 NL4
L5 NL5
FIG.6B SHS
FIG.6C DP
FIG.6D STD
FIG.6E OE

L1
OUT
L3
L5

NL1
NL3
NL5

L2
L4
L6

NL2
NL4
NL6
FIG.6J STD
FIG.6K HCK1
FIG.6L HCK2
FIG.6M HCK3
SAMP. TIMING
X1
X2
X3
X4
X5
X6
Xm-3
Xm-2
Xm-1
Xm

ODD FIELD (262H)
EVEN FIELD (263H)
N1(19H)
N2 (4H)
N1(19H)
N2+1(5H)
FIG.12A HSYC
FIG.12B VSYC

FIG.12G F1
FIG.12H SIO1
FIG.12I SIO2

MATRIX TYPE LIQUID CRYSTAL DISPLAY DEVICE

CROSS-REFERENCE TO RELATED APPLICATION

The present application is related to and claims priority from Japanese Patent Application No. Hei 7-279127, incorporated herein by reference.

BACKGROUND OF THE INVENTION

1. Field of the Invention

The present invention relates to a matrix type liquid crystal display device using an anti-ferroelectric liquid crystal medium.

2. Description of Related Art

Conventionally, a matrix type liquid crystal display device using an anti-ferroelectric liquid crystal medium is designed, for example, as shown in FIGS. 14A–14D, to display an image by driving scanning electrodes and signal electrodes while scanning the scanning electrodes according to the sequence of scanning lines so that a blanking period during which picture elements are dark displayed, a selecting period during which only picture elements necessary for bright display are inputted, and a holding period during which a pre-existing display condition is maintained, are repeated on a time-series basis.

In general, a picture signal such as a video signal is inputted to a liquid crystal display device in the form of a serial picture data so that a picture screen can be scanned both horizontally and vertically according to the drive mode of the display.

Thus, the selecting cycle of the scanning electrode has to be equalized to the vertical cycle of the picture signal to be inputted, unless the picture signal undergoes special data conversion processing. That is, the variation of the transmission cycle of image data for one picture frame directly corresponds to the picture producing cycle of the picture frame.

For example, in the case of the NTSC system, when a horizontal scanning period is 1 H, the frame period is 525 H. Also, in the case of the CRT, the field consists of odd-numbered fields and even-numbered fields in order to enable interlace scanning.

However, in the case of the liquid crystal display device, in general, interlace scanning is not carried out. Instead, the odd-numbered fields and the even-numbered field are superimposed on each other and displayed on a single display screen. Thus, the selecting cycle of the scanning electrode for displaying the odd-numbered fields differ by 1 H at a minimum from that for displaying the even-numbered fields.

In this case, the anti-ferroelectric liquid crystal medium needs to be driven with alternating current; however, if the voltage polarity is inverted from positive to negative or vice-versa for each selecting period, the difference in the selecting period corresponds to the difference in duration of the holding period. on the other hand, the voltage for maintaining the display condition is applied during the holding period. Thus, a DC voltage is applied to the anti-ferroelectric liquid crystal medium according to the above-described difference in duration of the holding period. This leads to phenomena such as burning or flickering of the display screen. These phenomena will be discussed in detail in the following with reference to FIGS. 14A–14D. Since the blanking period for each picture frame is constantly 4 H, the holding period of the picture frame corresponding to the odd-numbered field becomes 257 H, while the holding period of the picture frame corresponding to the even-numbered field is 258 H. When the polarity of the drive voltage is inverted for each selecting period, the difference in holding period by 1 H is applied, as a DC voltage, to the anti-ferroelectric liquid crystal medium, and this causes the above-described phenomena.

SUMMARY OF THE INVENTION

On this understanding, the present inventors studied the relationship between the variation of the transmission cycle of the picture data for a picture frame and the blanking period. From the result of this study, it was found that the duration of the holding period can be made constant by adjusting the duration of the blanking period corresponding to the variation in the transmission cycle, which is to be determined by actually measuring the transmission cycle of the picture data concerned.

For example, in the case of the NTSC system, given that the selecting cycle of the picture frame corresponding to the odd-numbered field is 262 H, whereas the selecting cycle of the picture frame corresponding to the even-numbered field is 263 H, when the blanking period of the picture frame corresponding to the even-numbered field is made longer by 1 H than the blanking period for the picture frame corresponding to the odd-numbered field, the holding periods of both the picture frames respectively corresponding to those fields can be equalized.

In the manner described above, including the case where the transmission cycle of the picture data for a picture frame varies, a DC voltage component can be prevented from being applied to the anti-ferroelectric liquid crystal medium without requiring any special conversion of picture signal data.

Thus, in consideration of what is described in the foregoing, an object of the present invention is to prevent burning and flickering of the display screen of the matrix type liquid crystal display device using an anti-ferroelectric liquid crystal medium by making the duration of the holding period constant.

The above-described object is achieved according to a first object of the present invention by providing a period control section of a liquid crystal panel drive section which applies a third voltage to a scanning electrode so that the duration of the third period for maintaining the condition of the picture element on the scanning electrode concerned is controlled to be constant.

In this manner, the DC voltage can be prevented from being applied to the anti-ferroelectric liquid crystal medium. As a result, burning and flickering of the display screen which likely to occur when DC voltage is applied to the anti-ferroelectric liquid crystal medium can be prevented.

Preferably, the period control section of the liquid crystal panel drive means unit the duration of a first period during which all the picture elements on one scanning electrode are blanked out by applying a first voltage to the scanning electrode in order to keep the aforementioned third period constant.

When a polarity inversion section inverts the polarity of the second voltage at the lapse of each odd-numbered cycle of the second period, the period control section controls the first period in accordance with the result of the inversion.

Furthermore, when a measuring section has measured the input cycle of the picture signal for one picture frame responding to the horizontal and vertical signals, the period control section controls the duration of the first period in accordance with the result of measurement and the horizontal and vertical synchronizing signals so that the duration of the third period becomes constant.

In this way, when the polarity inversion section inverts the polarity of the second voltage at the end of each odd-numbered cycle of the second period according to the result of the measurement by the measuring section, the period control section controls the first period in accordance with the result of the inversion.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which:

FIGS. 6A–6M are timing charts illustrating the operation of the signal electrode drive circuit;

FIGS. 12A–12I are timing charts illustrating the operation of the vertical display position adjusting circuit as shown in FIG. 11;

DETAILED DESCRIPTION OF THE PRESENTLY PREFERRED EXEMPLARY EMBODIMENTS

An embodiment of the present invention will be described in the following with reference to FIGS. 1 through 13D.

Figure 1:
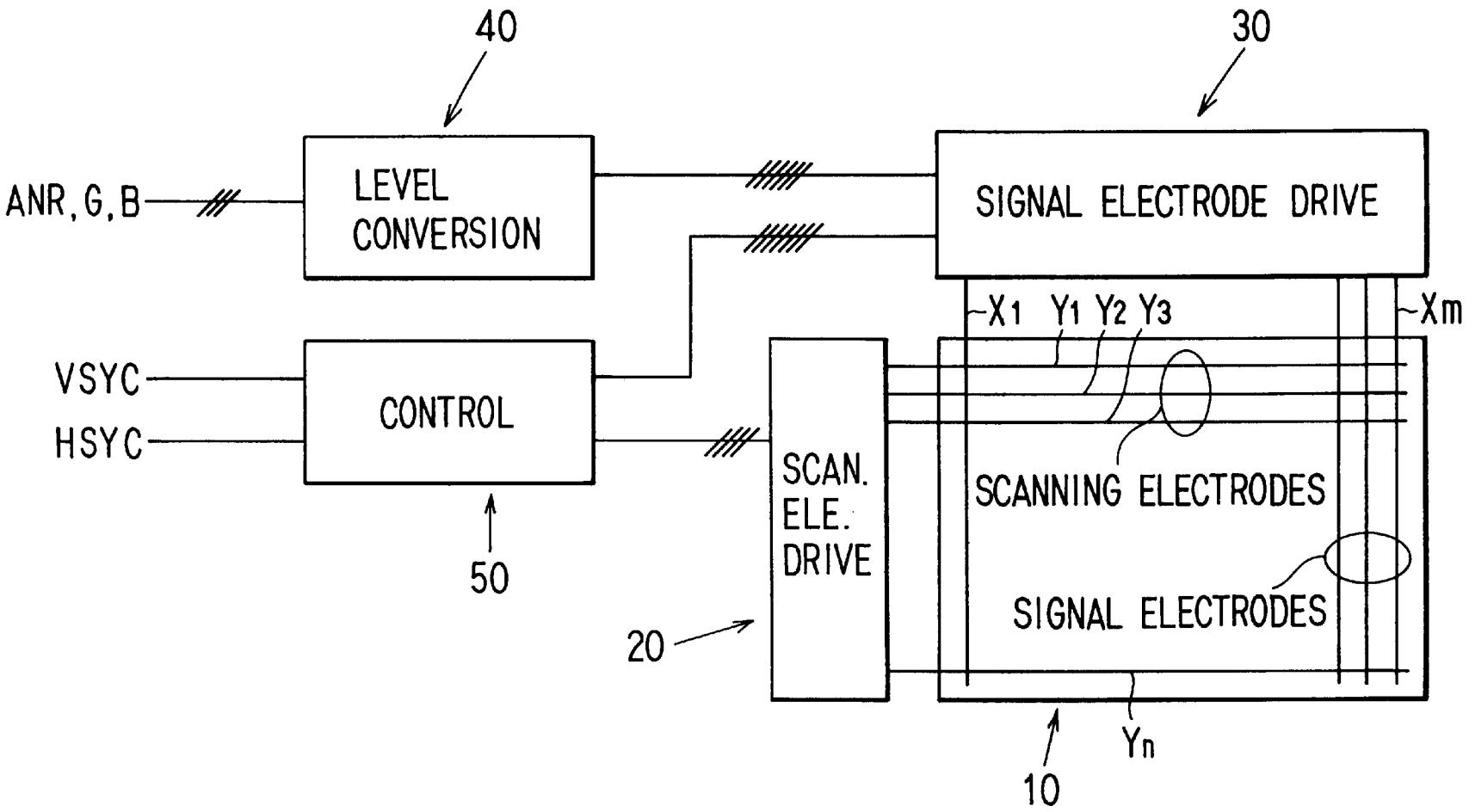
FIG. 1 is a general structural view of a liquid crystal display device according to the present invention.

FIG. 1 is a schematic general structural view of a matrix type liquid crystal display device according to the present invention.

This liquid crystal display device has a liquid crystal panel 10 including n scanning electrodes Y1 through Y*n* and m signal electrodes X1 through X*m* which are arranged in a lattice form to intersect the scanning electrodes Y1 to Y*n* through an anti-ferroelectric liquid crystal medium. In this case, the n scanning electrodes Y1 through Y*n*, m signal electrodes X1 through X*m* and the anti-ferroelectric liquid crystal medium constitute n×m matrix-form picture elements as a who.

Furthermore, this liquid crystal display device includes a scanning electrode drive circuit 20 and a signal electrode drive circuit 30 connected to the liquid crystal panel 10, a level conversion circuit 40 connected to the signal electrode drive circuit 30, and a control circuit 50 connected to the scanning electrode drive circuit 20 and the signal electrode drive circuit 30.

The scanning electrode drive circuit 20 is connected, as shown in FIG. 1, between the control circuit 50 and each of the scanning electrodes Y1 through Y*n*.

Figure 2:
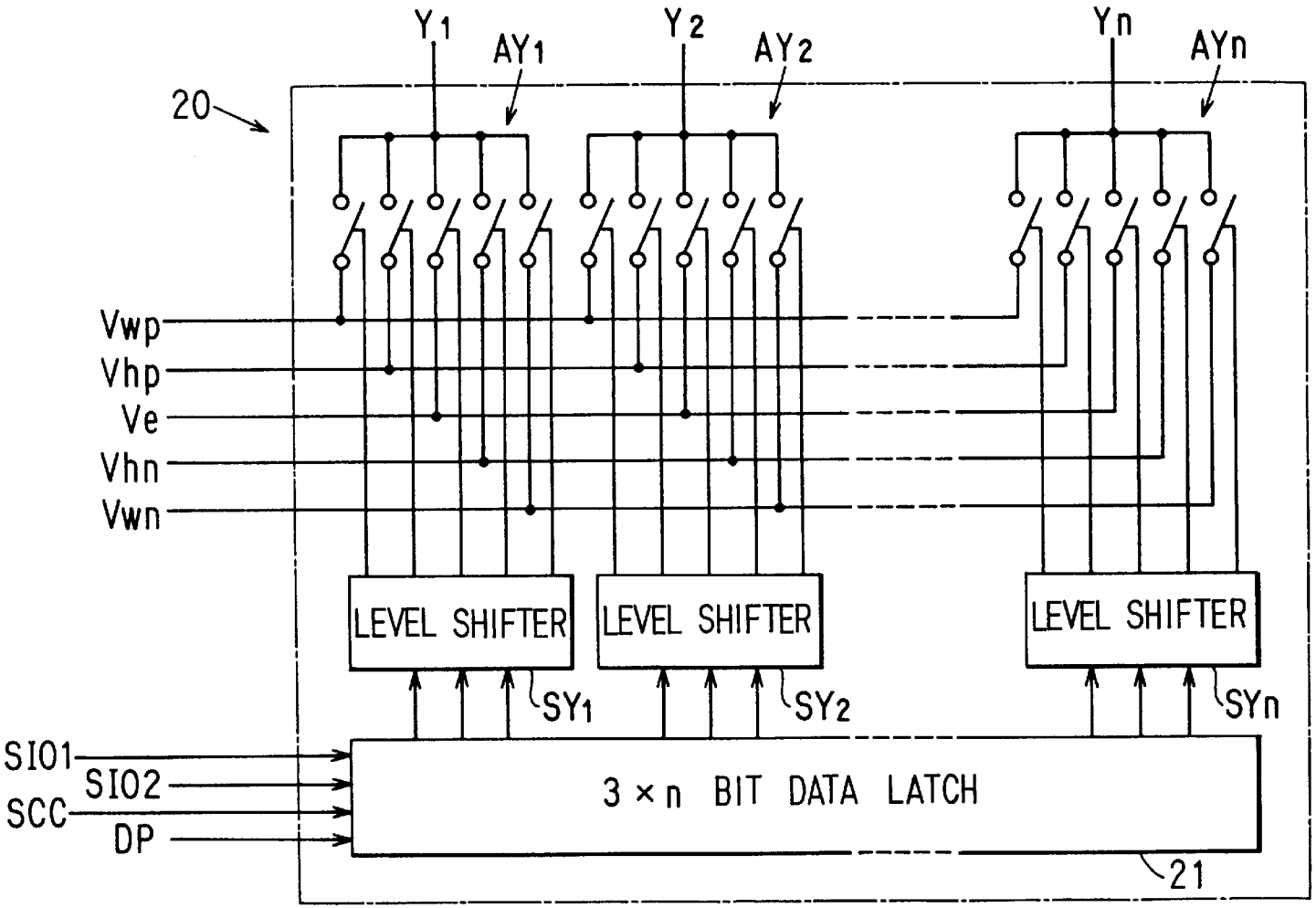
FIG. 2 is a detailed circuit diagram of a scanning electrode drive circuit as shown in FIG. 1.
Figures 3A, 3B, 3C, 3D, 3E, 3F, 3G:
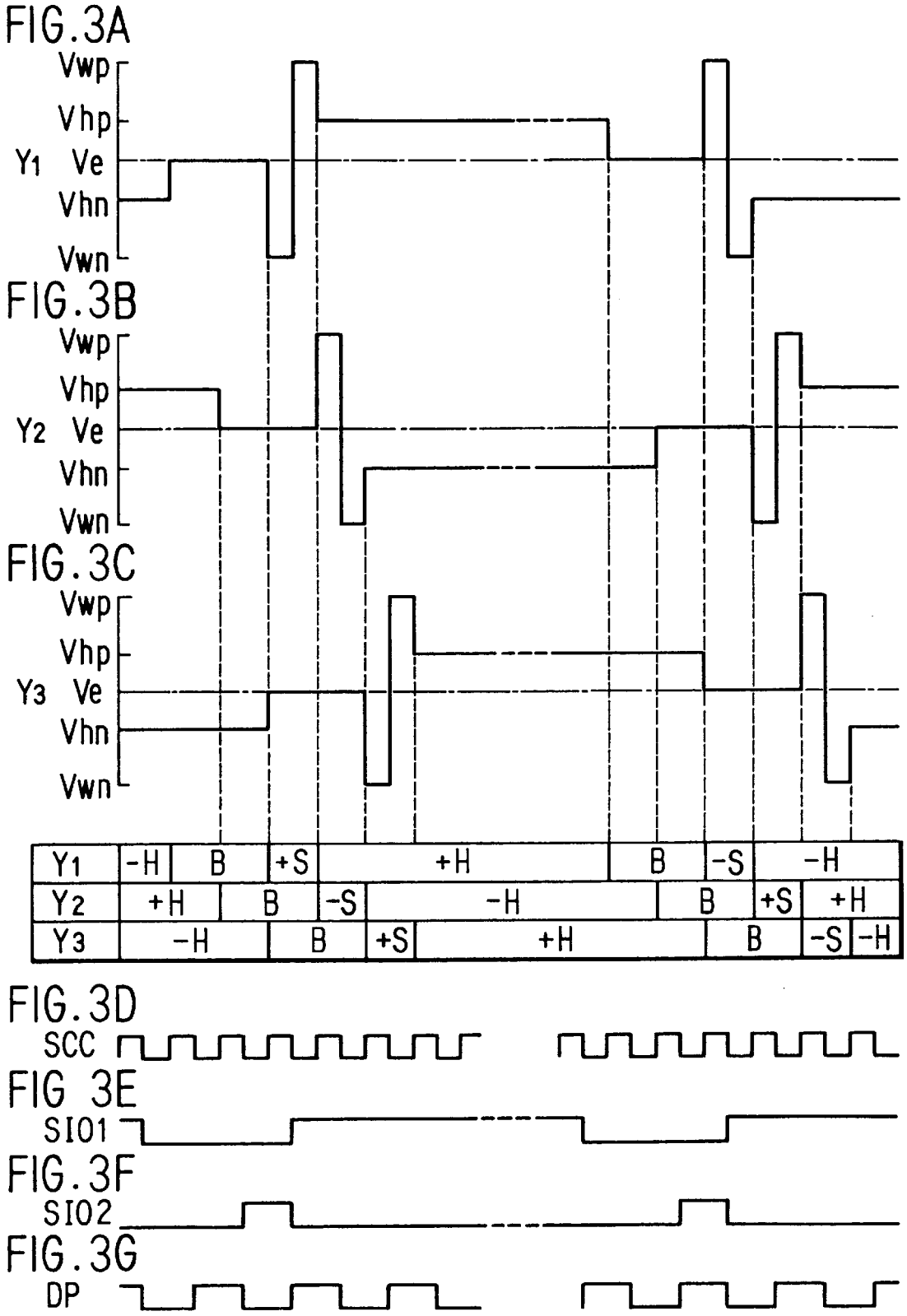
FIGS. 3A–3G are timing charts illustrating the operation of the scanning electrode drive circuit as shown in FIG. 2.

The scanning electrode drive circuit 20, as shown in FIG. 2, includes a 3×n-bit data latch 21 to which an SI01 signal, an SI02 signal, an SCC signal and a DP signal are inputted, n level shifters SY1 through SY*n* connected to the data latch 21, and n analog switch groups AY1 through AY*n* (each including five analog switches) respectively connected to the level shifters SY1 through SY*n*.

Thus, the scanning electrode drive circuit 20, as shown in FIGS. 3A–3G, sequentially outputs a voltage corresponding to each of blanking, selecting and holding conditions to each of the scanning electrodes Y1 through Y*n*. In these figures, the letters "B", "S" and "H" respectively indicate blanking, selecting and holding periods. Also, because the scanning electrode drive circuit 20 is driven with alternating current, voltage polarity is switched to either positive or negative for each selecting period.

In this embodiment, the SI01 signal, SI02 signal, SCC signal and DP signal are outputted from the control circuit 50 in a manner described below.

The conditions of the individual scanning electrodes Y1 through Y*n* are defined by the SI01 and SI02 signals. In this embodiment, the blanking condition is defined when both the SI01 and SI02 signals are at a low level; the selecting condition is defined when the SI01 signal is at a low level and the SI02 signal is at a high level; and the holding condition is defined when the SI01 signal is at a high level and the SI02 signal is at a low level. Furthermore, in order to control the conditions of the individual scanning electrodes Y1 through Y*n*, the SI01 and SI02 signals are synchronized with the rise of the SCC signal and latched by the data latch 21.

Furthermore, the DP signal determines the voltage polarity. When the scanning electrodes Y1 through Y*n* are in the selecting condition, for example, in the positive selecting period, the level of the DP signal is switched from low level to high level and output voltage is switched from Vwn to Vwp. Thus, data of the inputted DP signal directly determines the polarity of the selection voltage. Even after entering the holding period, the polarity corresponding to the data of the DP signal inputted during the immediately preceding selecting period is maintained, so that the polarity is not dependent on the DP signal any more.

The operation of the scanning electrode drive circuit 20 will be described below using the scanning electrode Y1 as an example and referring to FIGS. 2 and 3.

To provide a blanking period, blanking voltage Ve is provided to the scanning electrode Y1 through the analog switch group AY1, thereby causing all the picture elements on the scanning electrode Y1 for display to be blanked out. During a positive selecting period, a negative writing voltage Vwn is outputted first to the scanning electrode Y1 through the analog switch group AY1, and subsequently a positive writing voltage Vwp is outputted to the scanning electrode Y1 through the analog switch group AY1.

Furthermore, during a positive holding period, a holding voltage Vhp is outputted to the scanning electrode Y1 through the analog switch group AY1, whereby the content of the data to be displayed on the liquid crystal panel 10 is maintained until the next blanking period.

After the lapse of the blanking period, in order to start the next drive period with alternating current, there comes a negative selecting period having a polarity opposite that of the preceding selecting period. Then, a positive writing voltage Vwp is outputted first to the scanning electrode Y1 through the analog switch group AY1, and subsequently a negative writing voltage Vwn is outputted to the scanning electrode Y1 through the analog switch group AY1.

Furthermore, during a negative holding period, a holding voltage Vhn is outputted to the scanning electrode Y1 through the analog switch group AY1, so that the content of the data to be displayed on the liquid crystal panel 10 is maintained until the next blanking period. Thereafter, the foregoing operations will be repeated.

Since the individual scanning electrodes Y1 through Y*n* are scanned sequentially from Y1 to Y*n* in the scanning electrode drive circuit 20, a writing voltage with a waveform shifted by the selecting period is inputted to each scanning electrode following Y2 through the corresponding analog switch group. In this case, in order to prevent flickering of the liquid crystal panel 10, the voltage polarity is differentiated among individual scanning electrodes. For example, the polarity for the scanning electrode Y1 is positive, the polarity for Y2 is negative, the polarity for Y3 is positive, and so on.

As can be understood clearly from the foregoing explanation, the 3-bit data consisting of SI01, SI02 and DP signals is synchronized with the rise of the SCC signal and latched by the data latch 21 in the scanning electrode drive circuit 20; the latched data corresponding to each of the outputs of the scanning electrodes Y1 through Y*n* controls 5 units of analog switches constituting each of the analog switch groups AY1 through AY*n* via each of the level shifters SY1 through SY*n* to generate scanning electrode drive waveforms as shown in FIGS. 3A–3G.

Figure 4:
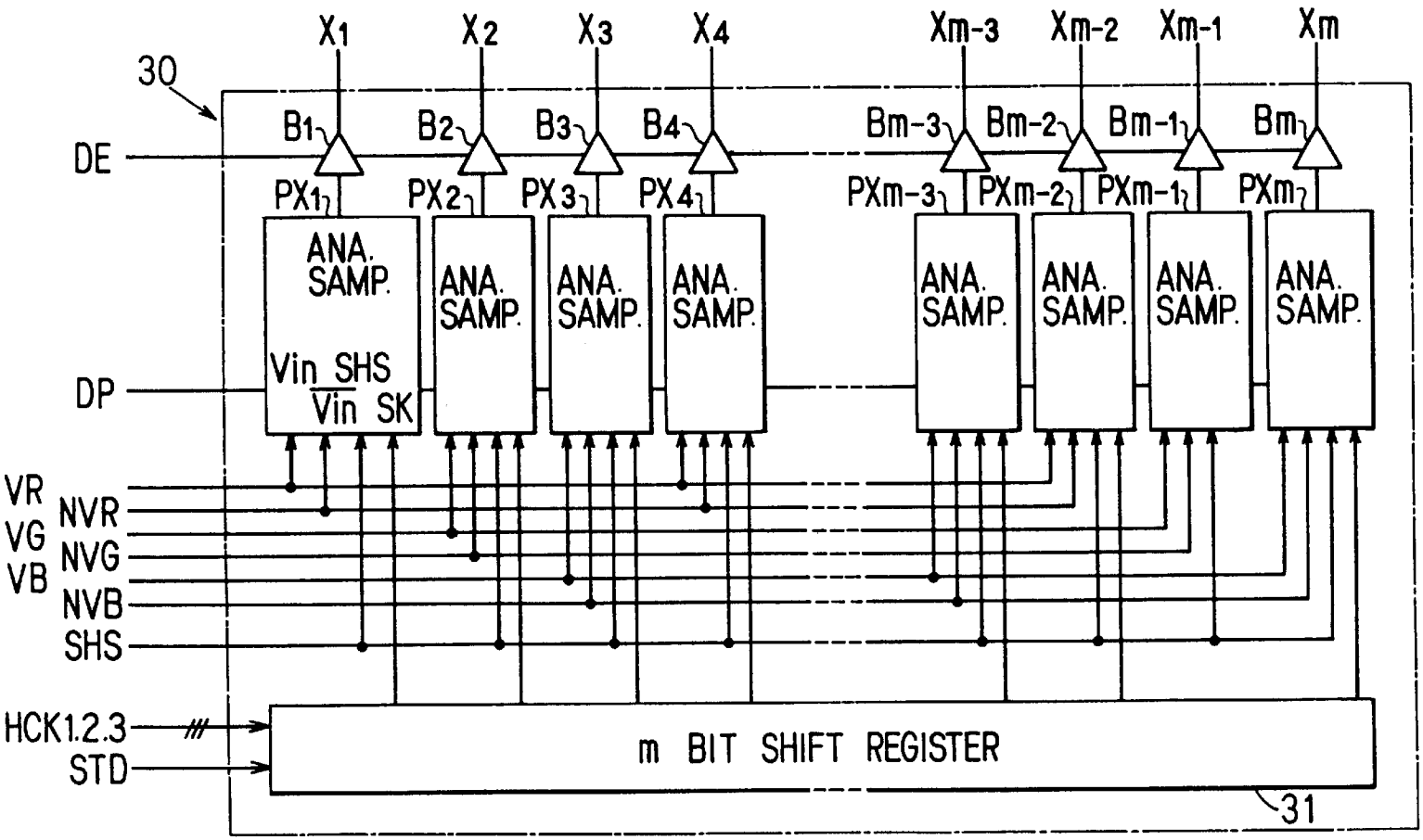
FIG. 4 is a detailed circuit diagram of a signal electrode drive circuit as shown in FIG. 1.

The signal electrode drive circuit 30, as shown in FIG. 1, is connected between the signal electrodes X1 through X*n* of the liquid crystal panel 10 and the level conversion and control circuits 40 and 50. The signal electrode drive circuit 30, as shown in FIG. 4, includes an m-bit shift register 31 which receives inputs of the HCK1 signal, the HCK2 signal, the HCK3 signal and the STD signal, m analog sampling circuits Px1 through Px*m* whose sampling timing is controlled by the shift register 31, and m output buffers B1 through B*m* connected to the analog sampling circuits Px1 through Px*m* respectively.

The m-bit shift register 31 receives the STD, HCK1, HCK2 and HCK3 signals generated by the control circuit 50 as described below. The STD signal determines the timing for inputting picture signal voltages for each scanning line. The HCK1 signal determines the timing for sampling picture signal voltage of each of the signal electrodes X1, X4, X7 . . . X*m*−2. The HCK2 signal determines the timing for sampling picture signal voltages of each of the signal electrodes X2, X5, X8 . . . X*m*−1. The HCK3 signal determines the timing for sampling picture signal voltages of each of the signal electrodes X3, X6, X9 . . . X*m*. The above picture signal voltages are outputted from the level conversion circuit 40 as described later. Thus, the timing for sampling is set as described below.

Figures 6A, 6F, 6G, 6H, 6I:
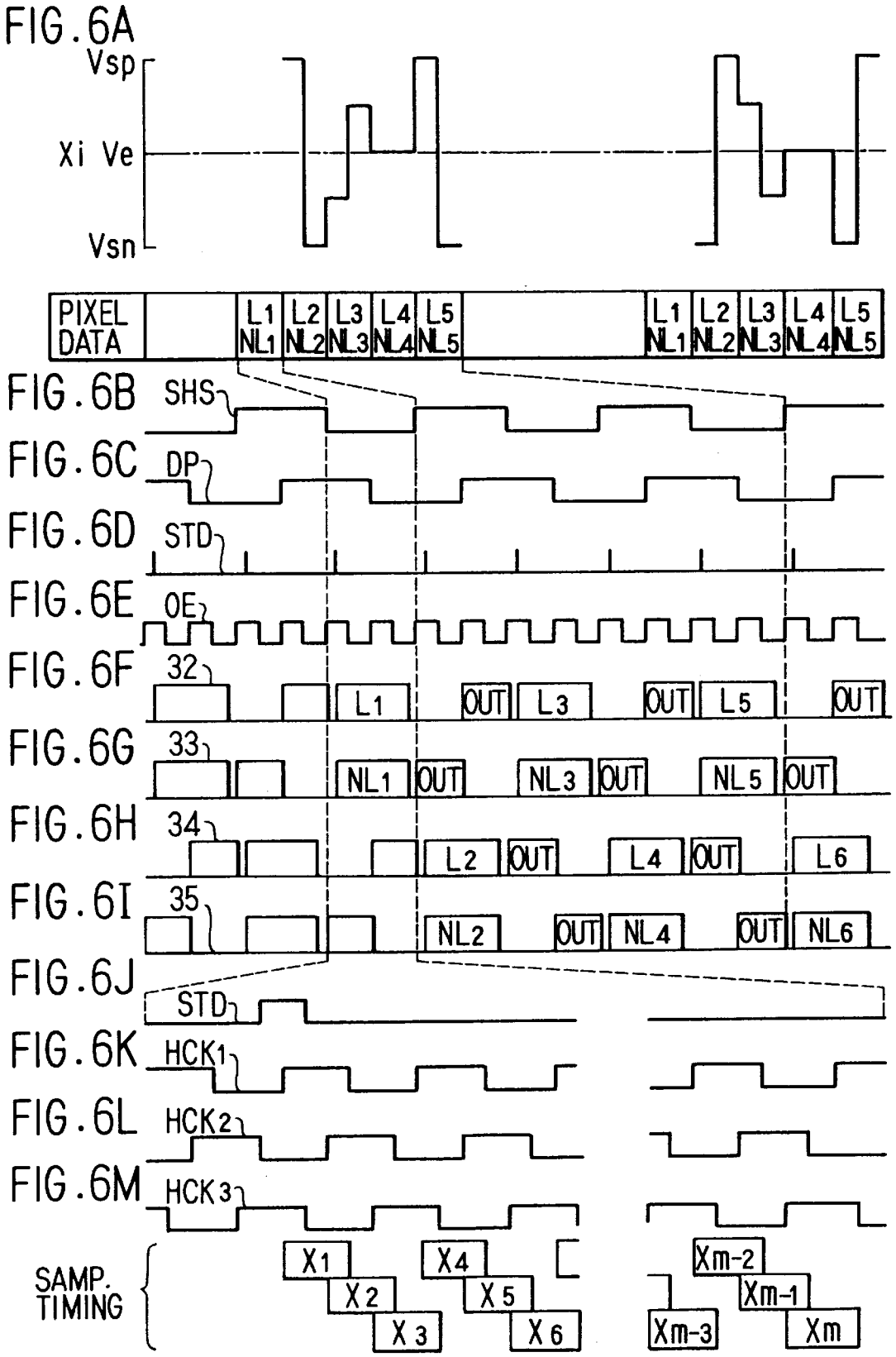

As shown in FIGS. 6A, 6D and 6K, when the STD signal is at high level, the timing for sampling picture signal voltages of the signal electrode X1 is set during a high level period of the HCK1 signal, that is, from the rise of the HCK1 signal until the initial fall of the same signal thereafter. When the HCK1 signal is still at a high level, the timing for sampling picture signal voltages of the signal electrode X2 is set during a high level period of the HCK2 signal, that is, from the rise of the HCK2 signal until the initial fall of the same signal thereafter, as shown in FIG. 6L. When the HCK2 signal is still at a high level, the timing for sampling picture signal voltage of the signal electrode X3 is set during a high level period of the HCK3 signal, that is, from the rise of the HCK3 signal until the initial fall of the same signal thereafter as shown in FIG. 6M. Then, the timings for sampling picture signal voltages of the signal electrodes X4, X5 . . . X*m* are set in a similar manner.

Thus, the m-bit shift register 31, responding to the STD, HCK1, HCK2 and HCK3 signals, outputs to each SK terminal of the analog sampling circuits Px1 through Px*m* a sampling timing signal for determining the sampling timing (refer to FIGS. 6A–6M) for inputting the picture signal voltage corresponding to each of the signal electrodes X1 through X*m* with respect to each scanning line.

Figure 5:
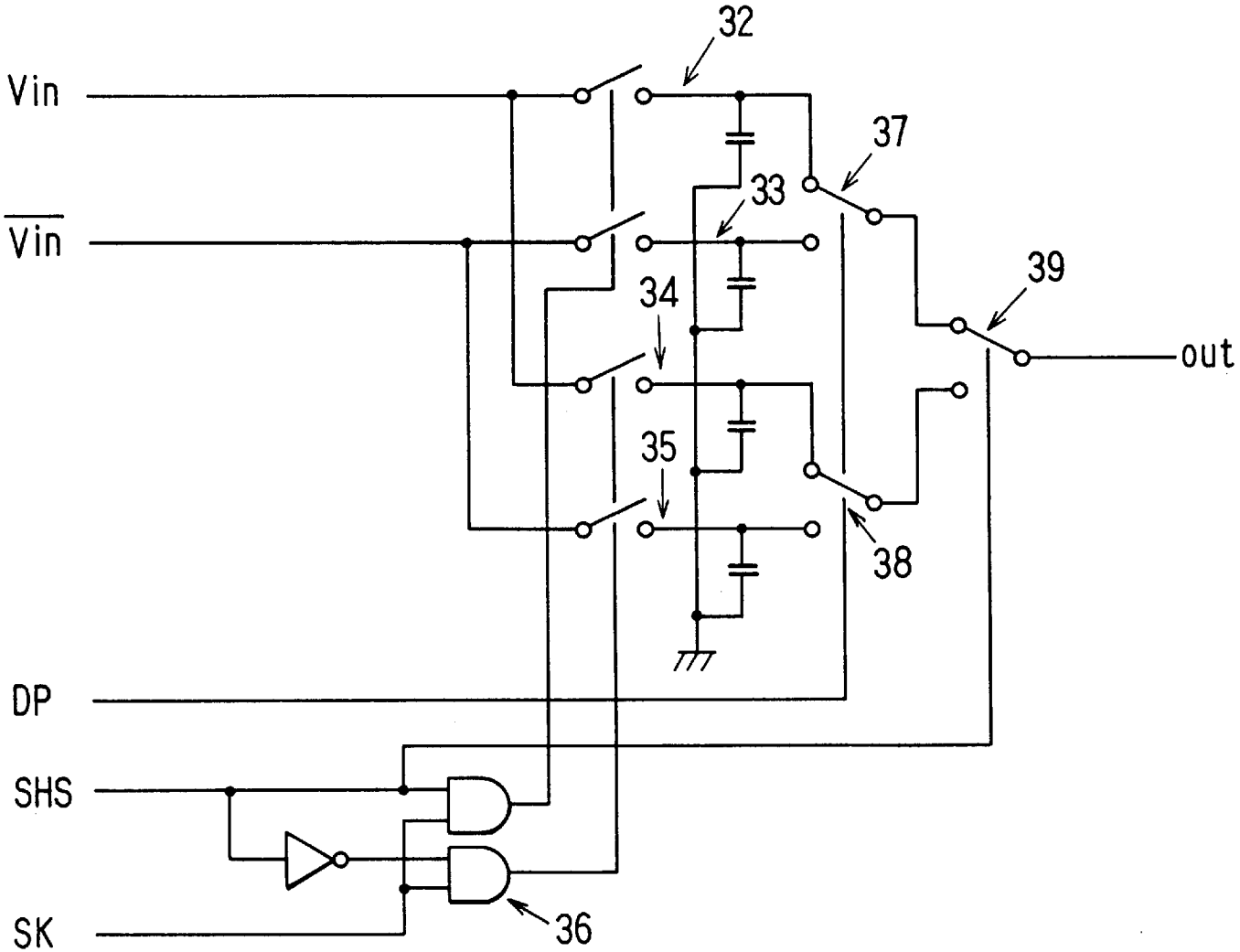
FIG. 5 is a detailed circuit diagram of an analog sampling circuit as shown in FIG. 4.

In each of the analog sampling circuits Px1 through P*x*m, responding to the sampling timing signal, both positive and negative picture signal voltages VR and NVR are inputted to the analog sampling circuits Px1, Px4, Px7 . . . Px*m*−2, which respectively correspond to the signal electrodes X1, X4, X7 . . . X*m*−2; both positive and negative picture signal voltages VG and NVG are inputted to the analog sampling circuits Px2, Px5, Px8 . . . Px*m*−1, which respectively correspond to the signal electrodes X2, X5, X8 . . . X*m*−1; and both positive and negative picture signal voltages VB and NVB are inputted to the analog sampling circuits Px3, Px6, Px9 . . . Px*m*, which respectively correspond to the signal electrodes X3, X6, X9 . . . X*m*. Each of the analog sampling circuits Px1 through Px*m*, as shown in FIG. 5, has four sample-and-hold circuits 32 through 35, each consisting of an analog switch and a capacitor.

The sample-and-hold circuits 32 and 34 respectively sample and hold positive picture signal voltages, whereas the sample-and-hold circuits 33 and 35 respectively sample and hold negative picture signal voltages.

The pair of the sample-and-hold circuits 32 and 34 and the pair of the sample-and-hold circuit 33 and 35 are designed as follows. When the pair of the sample-and-hold circuits 32 and 34 are in the holding condition to generate a holding signal, the pair of the sample-and-hold circuits 33 and 35 are in the sampling condition to sample picture signal voltages of the next scanning line. Thus, the sampling and holding conditions of the picture signal voltage are switched alternately. Such switching of operation is performed, through a switching circuit 36, responding to the SHS signal (refer to FIG. 6B) for causing the level of each scanning line to be switched between high and low levels.

In this stage, a signal for causing the picture signal voltage to be sampled is outputted from the switching circuit 36 to the pair of the sample-and-hold circuits in the sampling condition, in response to a sampling timing signal inputted to the above-mentioned SK terminal.

Furthermore, both the analog switches 37 and 38 are controlled by the above-mentioned DP signal, which represents the polarity of the scanning electrode. Thereby, a positively or negatively held picture signal voltage is outputted from a pair of sample-and-hold circuits in the holding condition. Furthermore, the analog switch 39 is controlled by the SHS signal which selects the output for each scanning line, and eventually the picture signal voltages selected by the analog switches 37, 38 and 39 are outputted.

The analog sampling circuits Px1 through Px*m* are operated as described above, and the picture signal voltages are simultaneously outputted from the output buffers B1 through B*m* to the signal electrodes X1 through X*m*, in response to high level timing of an OE signal generated by the control circuit 50 as described later.

The operation of the signal electrode drive circuit 30 thus constructed will be explained in the following with reference to FIGS. 6A–6M. FIGS. 6F–6I show timings at which the picture signal voltages corresponding to data Lj and NLj of all the picture elements arranged on the j-th signal electrode are sampled and outputted by the sample-and-hold circuits 32 through 35, where 1, 2, 3 . . . may be substituted into the variable j. In this case, the picture data given as Lj is generated by positive picture signal voltages VR, VG and VB, while the picture data given as NLj is generated by negative picture signal voltages NVR, NVG and NVB.

The data L1 and NL1 of all the picture elements arranged on the first signal electrode are respectively sampled by the sample-and-hold circuits 32 and 33, which respectively correspond to each of the outputs. The switching of the sample-and-hold circuits is controlled by the SHS signal as described previously.

More specifically, when the SHS signal is at a low level, the sampling is carried out by the sampling circuits 32 and 33, whereas when the SHS signal is at a high level, the sampling is carried out by the sampling circuits 34 and 35. The sampling is started with the rise of the HCK1 signal when the STD signal is still at a high level. In the analog sampling circuit corresponding to the signal electrode X1, the sampling of positive picture signal voltage VR by the sample-and-hold circuit 32 and the sampling of negative signal voltage NVR by the sample-and-hold circuit 33 are carried out during the high level period of the HCK1 signal, that is, from the rise of the HCK1 signal when the STD signal is still at a high level until the initial fall of the HCK1 signal thereafter. Then, the sampled voltages are held after the initial fall of the HCK1 signal.

In the analog sampling circuit corresponding to the signal electrode X2, the amplification of positive picture signal voltage G by the sample-and-hold circuit 32 and the sampling of negative signal voltage NVG by the sample-and-hold circuit 33 are carried out during the high level period of the HCK2 signal, that is, from the rise of the HCK2 signal when the HCK1 signal is still at a high level until the initial fall of the HCK2 signal thereafter. Then, the amplified and sampled voltages are held after the initial fall of the HCK2 signal.

In the analog sampling circuit corresponding to the signal electrode X3, the sampling of a positive picture signal voltage VB by the sample-and-hold circuit 32 and the sampling of a negative picture voltage NVB by the sample-and-hold circuit 33 are carried out during the high level period of the HCK3 signal, that is, from the rise of the HCK3 signal when the HCK2 signal is still at a high level until the initial fall of the HCK3 signal thereafter. Then, the sampled voltages are held after the initial fall of the HCK3 signal.

Thereafter, in each of the analog sampling circuits corresponding to the signal electrodes X4, X5 . . . X*m*, the sampling is carried out as described above. Then, the voltages sampled by the sample-and-hold circuit 33 are outputted simultaneously to the signal electrodes X1 through X*m*. After that, the voltages sampled by the sample-and-hold circuit 32 are outputted simultaneously to the signal electrodes X1 through X*m*. The output of the sample-and-hold circuit is controlled by the DP and OE signals.

When the DP signal is at a low level, the sample-and-hold circuits 33 and 35 become ready for generating an output, and the OE signal reaches its high level. Thus, the output can be supplied simultaneously to the signal electrodes X1 through X*m*. When the DP signal is at a high level, the sample-and-hold circuits 32 and 34 become ready for generating an output, and the OE signal reaches its high level. Thus, the output can be supplied simultaneously to the signal electrodes X1 through X*m*.

While the sampling voltages of the sample-and-hold circuits 32 and 33 are outputted, the data L2 and NL2 of all the picture elements arranged on the next second scanning electrode are respectively sampled by the sample-and-hold circuits 34 and 35 of the analog sampling circuit corresponding to the respective outputs.

Then, the voltages sampled by the sample-and-hold circuit 34 are outputted simultaneously to the signal electrodes X1 through X*m*. Subsequently, the voltages sampled by the sample-and-hold circuit 35 are outputted simultaneously to the signal electrodes X1 through X*m*.

While the sampled voltages are outputted from the sample-and-hold circuits 34 and 35, the data L3 and NL3 of all the picture elements arranged on the next third scanning electrode are respectively sampled by the sample-and-hold circuits 32 and 33 of the analog sampling circuit corresponding to the respective outputs.

Then, the voltages sampled by the sample-and-hold circuit 33 are outputted simultaneously to the signal electrodes X1 through X*m*. Subsequently, the voltages sampled by the sample-and-hold circuit 32 are outputted simultaneously to the signal electrodes X1 through X*m*. Thereafter, similar operations are performed.

Figure 7:
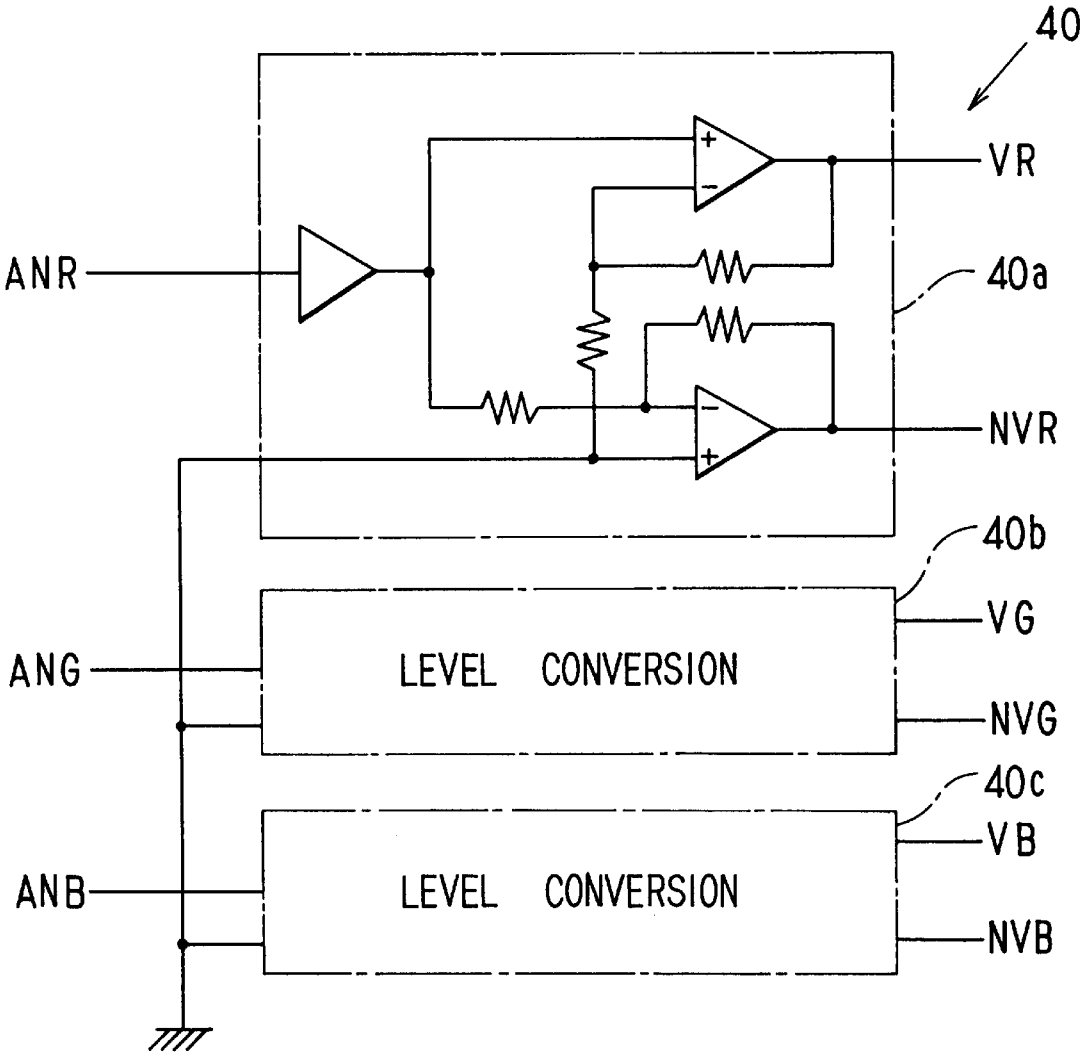
FIG. 7 is a detailed circuit diagram of a level conversion circuit as shown in FIG. 1.

The level conversion circuit 40 receives the inputted picture data signals ANR, ANG and ANB, which respectively correspond to RGB, as data respectively corresponding to the picture elements on each of the scanning electrodes Y1 through Y*n*, continuously from the outside through the signal electrodes X1 through X*m* (refer to FIG. 1 and FIG. 7). Then, the level conversion circuit 40 amplifies A times and—A times each of the picture data ANR, ANG and ANB by each of the level converters 40*a* through 40*c* (having identical structures), thereby generating them as positive picture signal voltages VR, VG and VB, and negative picture signal voltages NVR, NVG and NVB (N represents inverse polarity) and outputting them to the signal electrode drive circuit 30.

Next, the composition of the control circuit 50 constituting a part of the present invention will be explained with reference to FIGS. 1 and 8.

Figure 8:
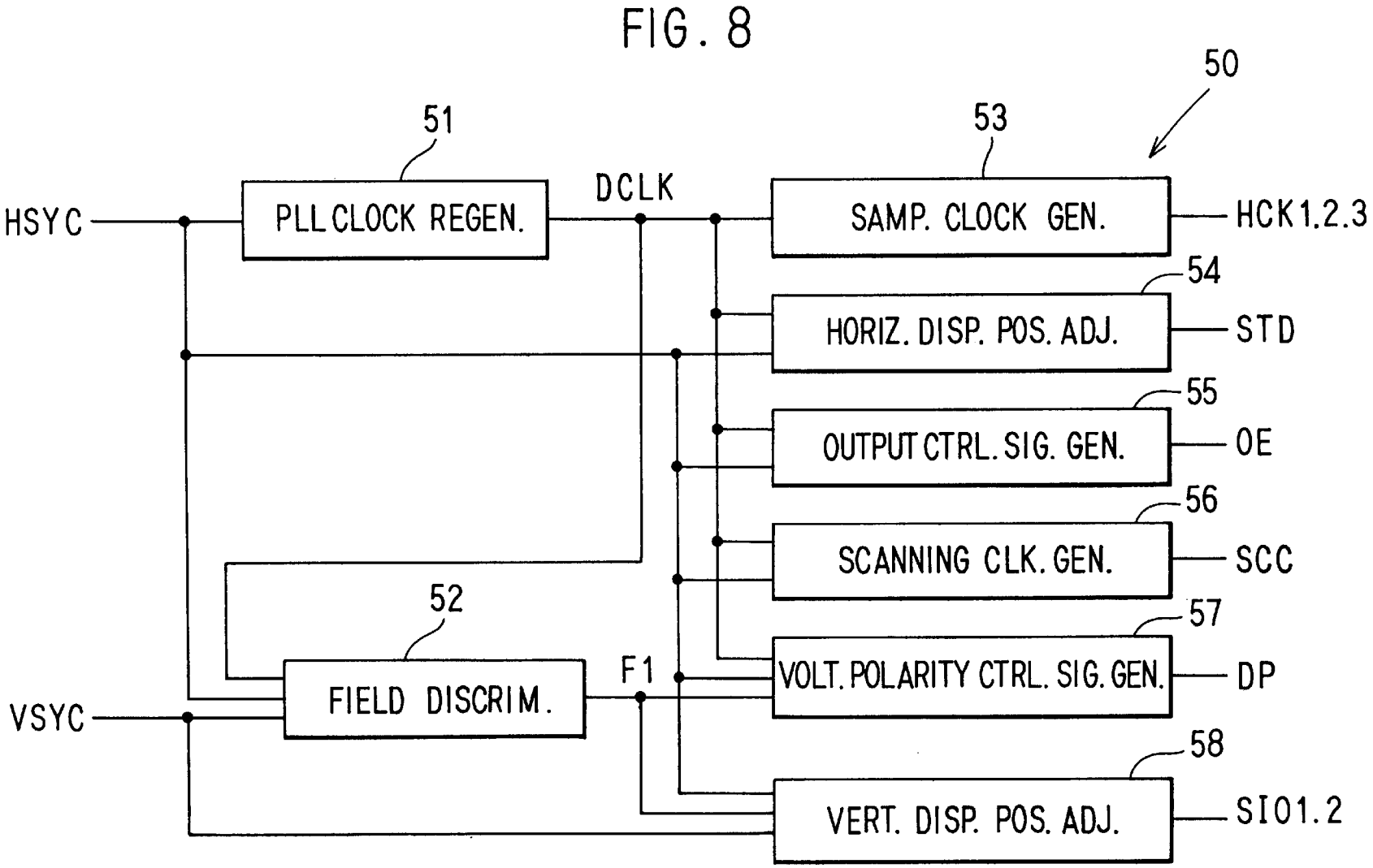
FIG. 8 is a detailed circuit diagram of a control circuit as shown in FIG. 1.

The control circuit 50, as shown in FIG. 8, includes a PLL clock regeneration circuit 51, which receives an externally inputted horizontal synchronizing signal HSYC, thereby generating a dot clock DCLK synchronized with the horizontal synchronizing signal HSYC.

Furthermore, the control circuit 50, as shown in FIG. 8, includes a field discriminating circuit 52. This embodiment adopts the television type display method according to the NTSC system in which the cycles of the odd-numbered fields and the even-numbered fields are predetermined. Thus, the field discriminating circuit 52 is designed to be capable of discriminating the fields with reference to a vertical synchronizing signal VSYC and the horizontal synchronizing signal HSYC and capable of controlling the fields so that the duration of the blanking period of the even-numbered fields is longer by 1 H than the duration of the blanking period of the odd-numbered fields, as shown in FIGS. 13A–13D.

Figure 9:
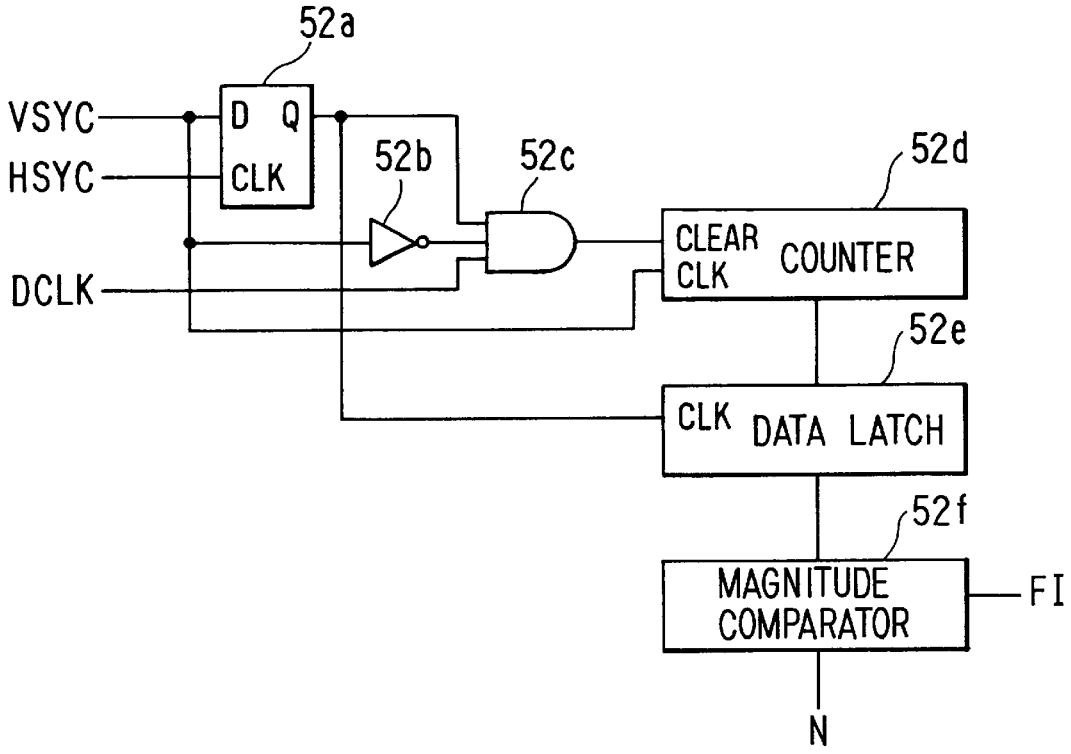
FIG. 9 is a detailed circuit diagram of a field discriminating circuit as shown in FIG. 8.

The field discriminating circuit 52, as shown in FIG. 9, includes a D-type flip-flop 52*a*, an inverter 52*b* and an AND gate 52*c*.

Figure 10A:
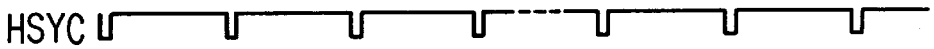
FIGS. 10A–10D are timing charts illustrating the operation of the field discriminating circuit as shown in FIG. 9.
Figure 10B:
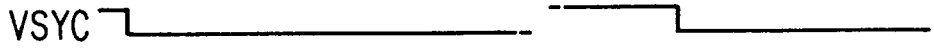
Figure 10C:
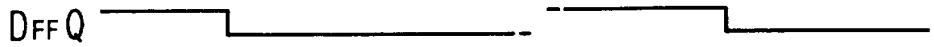
Figure 10D:
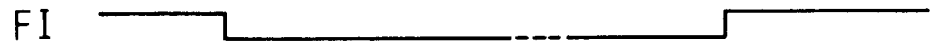

The flip-flop 52*a* receives the externally-inputted vertical and horizontal synchronizing signals VSYC and HSYC, and receives the vertical synchronizing signal VSYC at the fall of the horizontal synchronizing signal HSYC (refer to FIGS. 10A and 10B). This means that the field is discriminated at the fall of the vertical synchronizing signal. Then, the output from the output terminal Q of the flip-flop 52*a* falls in synchronization with the initial fall of the horizontal synchronizing signal HSYC after the fall of the vertical synchronizing signal VSYC (refer to FIGS. 10A and 10B).

The inverter 52*b* inverts the externally-provided vertical synchronizing signal VSYC to output the inverted vertical synchronizing signal. The AND gate 52*c* receives the output from the output terminal Q of the flip-flop 52*a*, the output from the inverter 52*b* and the dot clock DCLK from the PLL clock regeneration circuit 51, and outputs the gate output to a counter 52*d*.

The counter 52*d* is cleared when the vertical synchronizing signal VSYC is at high level and becomes ready to count with the fall of the vertical synchronizing signal VSYC. Then, the counter 52*d* receives the output of AND gate 52*c* as a clock, and counts from the fall of the vertical synchronizing signal VSYC to the initial fall of the horizontal synchronizing signal HSYC.

A data latch 52*e* receives the output from the output terminal Q of the flip-flop 52*a* and, synchronizing with the fall of this received output, receives the count data outputted from the counter 52*d* to latch the received data. A magnitude comparator 52*f* compares the latched count output with a predetermined value N which has been set previously. Then, when the latched count output is larger than the predetermined value N, the magnitude comparator 52*f*, at low level, outputs a field signal FI. On the other hand, when the latched count output is smaller than the predetermined value N, the magnitude comparator 52*f*, at high level, outputs the field signal FI.

The control circuit 50, as shown in FIG. 8, includes a sampling clock generating circuit 53, a horizontal display position adjusting circuit 54, an output control signal generating circuit 55, a scanning clock generating circuit 56 and a voltage polarity control signal generating circuit 57.

The sampling clock generating circuit 53, responding to the dot clock DCLK from the PLL clock regenerative circuit 51, outputs the HCK1, HCK2 and HCK3 signals as the sampling clocks for sampling the picture signal to the signal electrode drive circuit 30.

The horizontal display position adjusting circuit 54, responding to the horizontal synchronizing signal HSYC from outside and dot clock DCLK from PLL clock regenerative circuit 51, outputs a picture signal sampling start control signal, that is, the horizontal display position adjusting signal, as the STD signal.

The output control signal generating circuit 55, responding to the horizontal synchronizing signal HSYC from outside and the dot clock DCLK from the PLL clock regenerative circuit 51, generates an output control signal as the OE signal to the signal electrode drive circuit 30.

The scanning clock generating circuit 56, responding to the horizontal synchronizing signal HSYC from outside and the dot clock DCLK from the PLL clock regenerative circuit 51, generates a scanning control clock, as the SCC signal, to the scanning electrode drive circuit 20.

The voltage polarity control signal generating circuit 57, responding to the horizontal synchronizing signal HSYC from outside, the dot clock DCLK from the PLL clock regenerative circuit 51 and the field signal FI from the field discriminating circuit 52, generates an output voltage polarity control signal, as the DP signal, to the scanning electrode drive circuit 20 and the signal electrode drive circuit 30.

Figure 11:
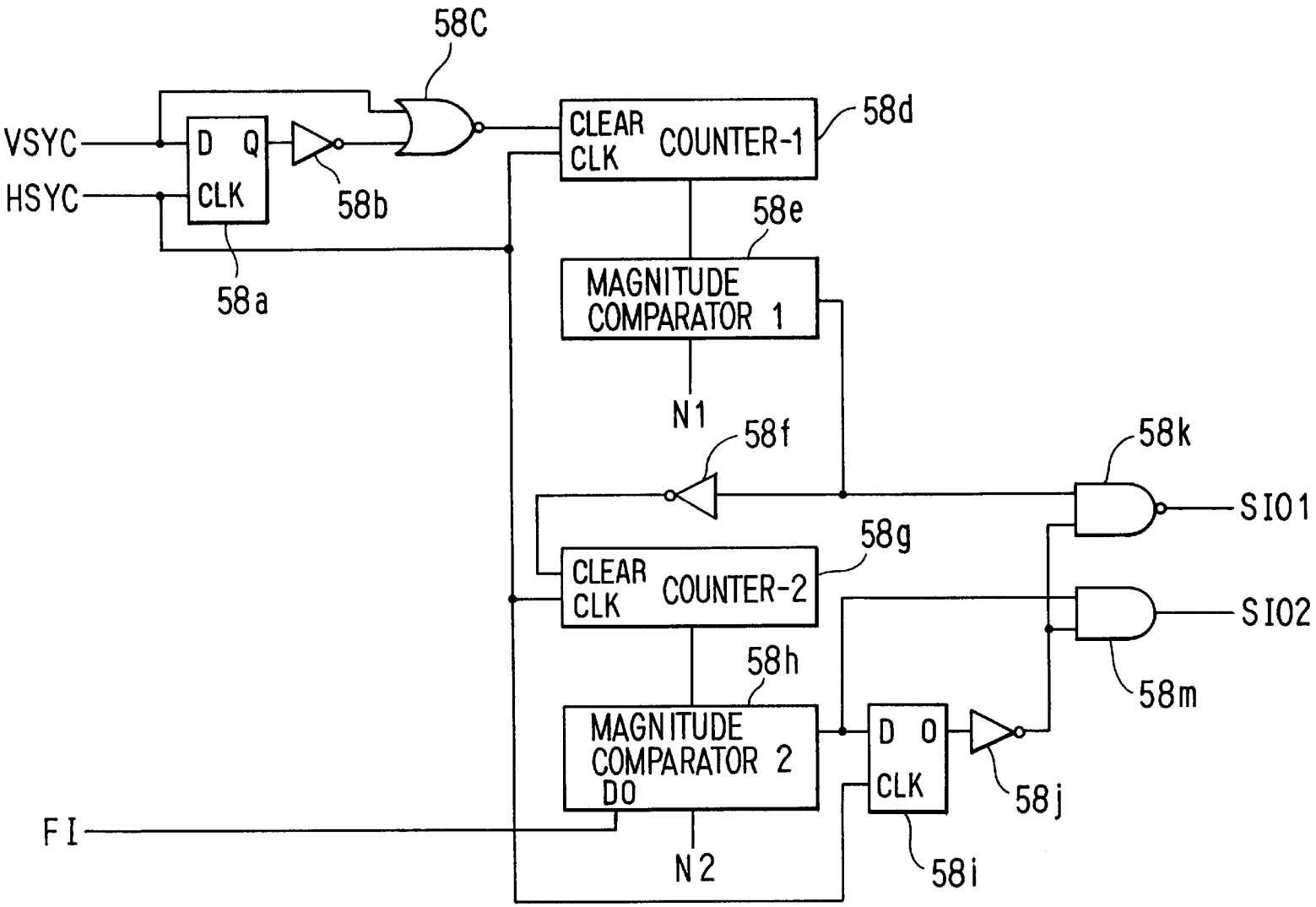
FIG. 11 is a detailed circuit diagram of a vertical display position adjusting circuit as shown in FIG. 8.
Figures 12C, 12D, 12E, 12F:
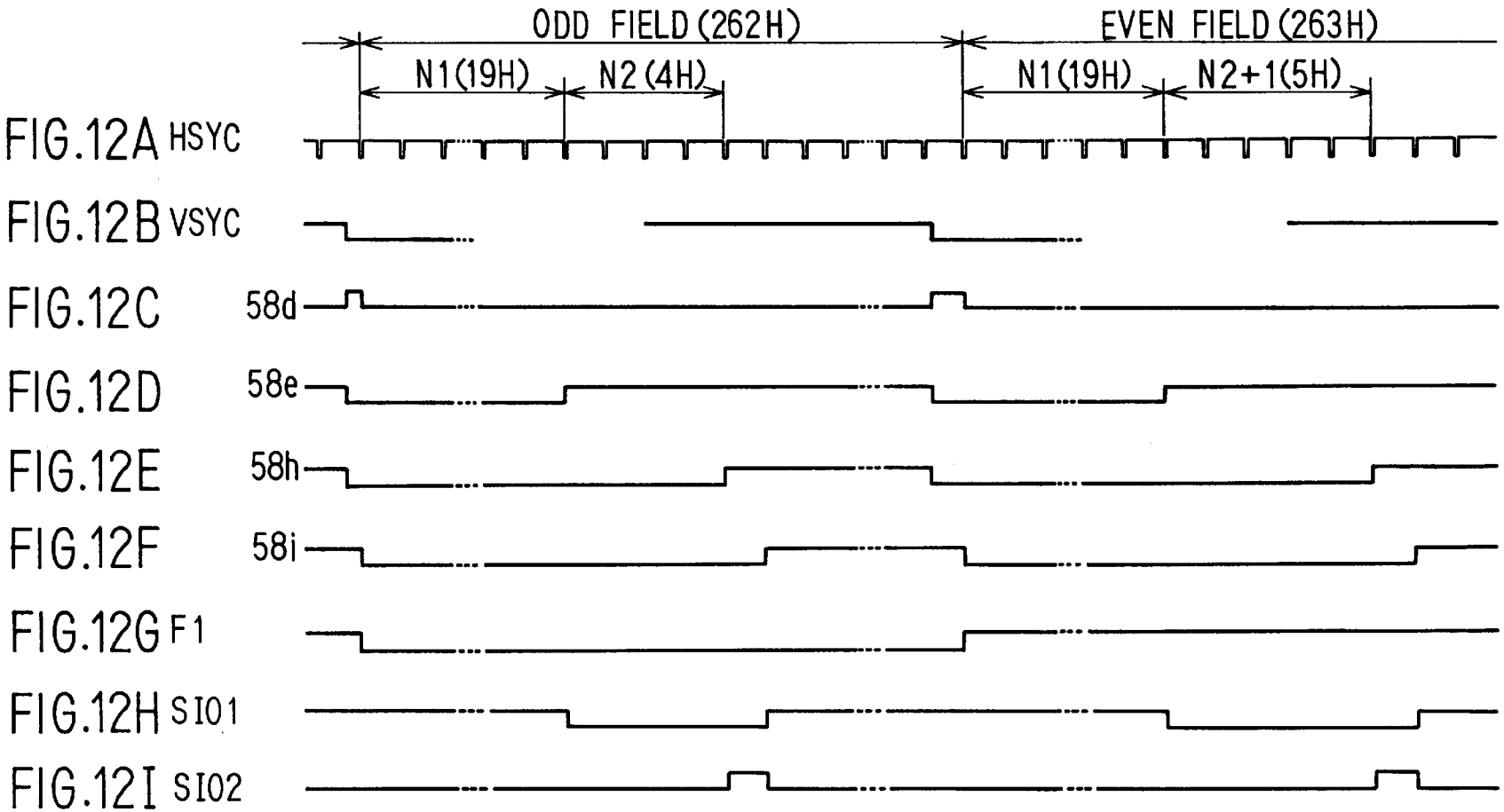
Figures 13A, 13B, 13C, 13D:
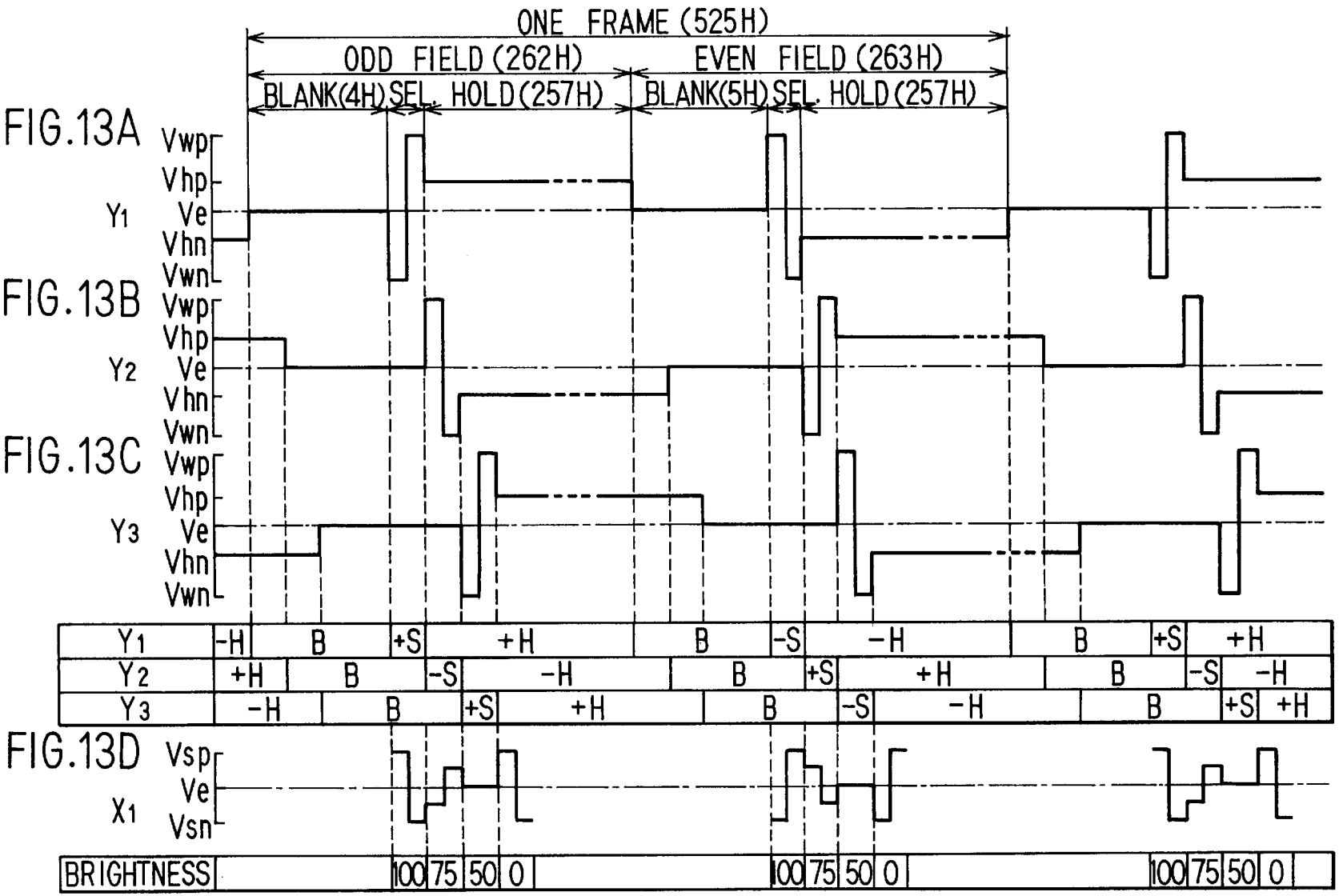
FIGS. 13A–13D are drive waveform diagrams of scanning electrodes and a signal electrode.
Figures 14A, 14B, 14C, 14D:
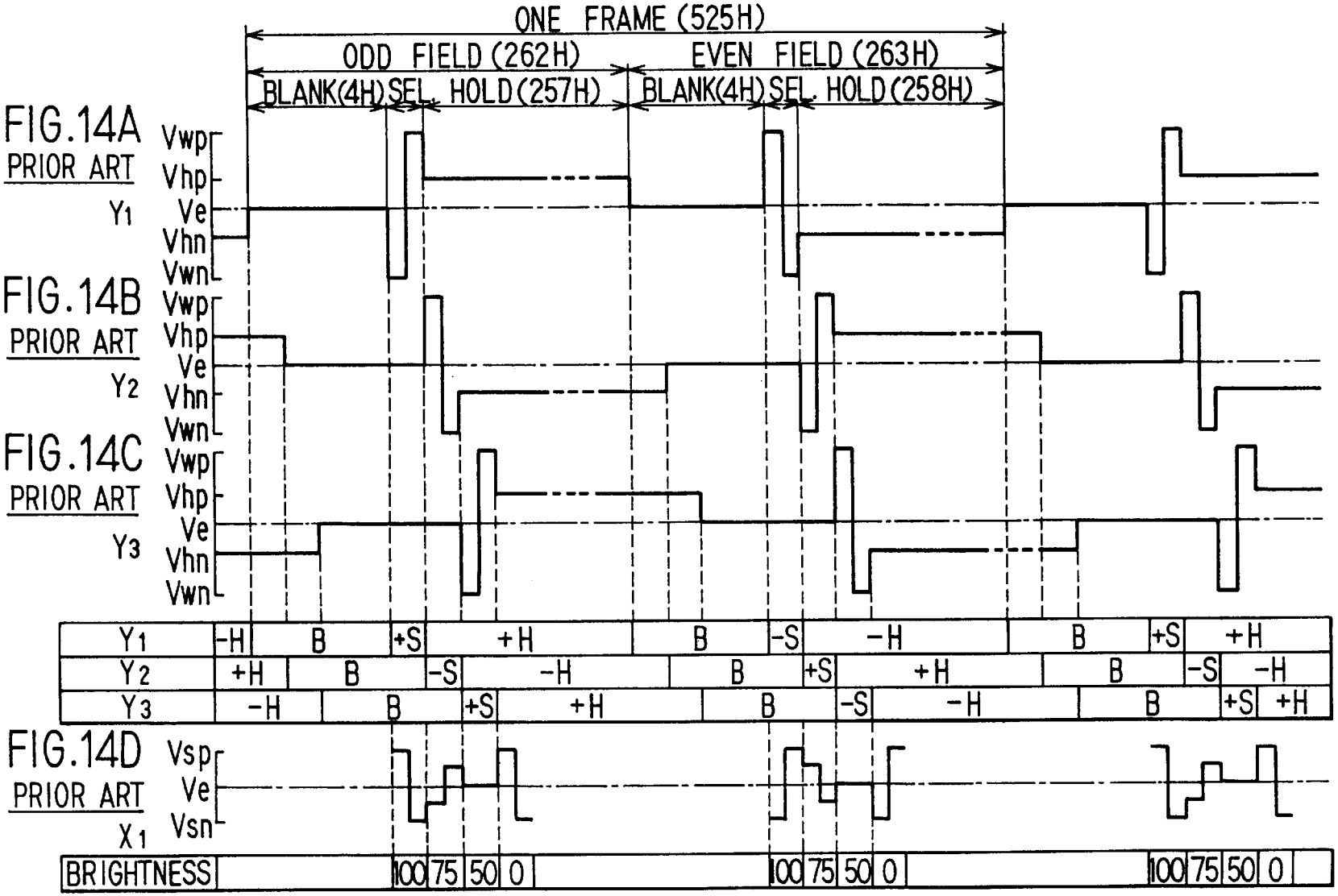
FIG.14A PRIOR ART
FIG.14B PRIOR ART
FIG.14C PRIOR ART
FIG.14D PRIOR ART
FIGS. 14A–14D are drive waveform diagrams of scanning electrodes and a signal electrode according to a conventional liquid crystal display device.

Furthermore, the control circuit 50, as shown in FIGS. 8 and 11, includes vertical display position adjusting circuit 58. The vertical display position adjusting circuit 58 operates as a blanking period adjusting circuit. The vertical display position adjusting circuit 58 includes a D-type flip-flip 58*a*. The flip-flop 58*a* is capable of receiving the vertical synchronizing signal VSYC with the rise of the horizontal synchronizing signal HSYC, in response to the inputting of the horizontal synchronizing signal HSYC and the vertical synchronizing signal VSYC from outside (refer to FIGS. 12A–12I). The flip-flop 58*a* generates an output from its output terminal Q.

The inverter 58*b* inverts the output from the output terminal Q and supplies the output of the inverted output to a NOR gate 58*c*. The NOR gate 58*c* generates an output for a negative logical sum in response to the vertical synchronizing signal and the inverted output from the inverter 58*b*.

The counter 58*d*, responding to the output for the negative logical sum from NOR gate 58*c* and the horizontal synchronizing signal HSYC, is cleared from the fall of the vertical synchronizing signal VSYC to the fall of the initial horizontal synchronizing signal HSYC, and, after the fall of the output for the negative logical sum, counts the number of times of the fall of the horizontal synchronizing signal HSYC (refer to FIG. 12A).

The magnitude comparator 58*e*, at high level, generates an output signal when the count value of the counter 58*d* has exceeded the predetermined set value N1. The inverter 58*f* inverts the output signal from the magnitude comparator 58*e* and outputs the inverted signal to the counter 58*g*. In this case, the set value N1 is for determining the display position in the vertical direction in the picture screen, and numeral value 19 is set as the set value N1.

The counter 58*g* is cleared by the inverted output from the inverter 58*f* and counts the number of times of the fall of the horizontal synchronizing signal HSYC from the point at which the count value of the counter 58*d* has exceeded the set value. The magnitude comparator 58*h* receives the input of the field discriminating signal FI from the field discriminating circuit 52 through its lowest-order bit input terminal D0 and receives the input of the set value N2 through its higher-order bit input terminal. Then, the magnitude comparator 58*h*, at high level, generates an output signal when the count value has exceeded the set value N2. In this case, the set value N2, which is for determining the blanking period of the odd-numbered field, is set as a numeral value 4.

The D-type flip-flop 58*i* receives the output signal from the magnitude comparator 58*h* at the fall of the horizontal synchronizing signal HSYC and generates an output from its output terminal Q. An inverter 58*j* inverts the output from the output terminal Q of the flip-flop 58*i* and outputs the inverted output to an NAND gate 58*k* and an AND gate 58*m*.

The NAND gate 58*k*, in response to the output signal from the magnitude comparator 58*e* and the inverted output from the inverter 58*d*, outputs a negative logical product as the SI01 signal. The AND gate 58*m*, in response to the output signal from the magnitude comparator 58*h* and the inverted output from the inverter 58*d*, outputs a logical product as the SI02 signal. The SI01 and SI02 signals, as described previously, are the signals for defining the condition of the scanning electrode and used for controlling the start of scanning, the blanking period, the selecting period and the holding period in the scanning electrode drive circuit 20.

In this embodiment, in the case of the odd-numbered field, both the SI01 and SI02 signals are generated at a low level for the duration of 4 H during 19 H from the fall of the vertical synchronizing signal VSYC and from the initial fall of the horizontal synchronizing signal HSYC. Then, the SI01 and SI02 signals are respectively generated at a low level and a high level for the duration of 1 H. In the case of the even-numbered fields, both the SI01 and SI02 signals are generated at a low level for the duration of 5 H during 19 H from the fall of the vertical synchronizing signal VSYC and from the initial fall of the horizontal synchronizing signal HSYC. Then, the SI01 and SI02 signals are generated at la ow level and a high level for the duration of 1 H.

According to this embodiment, the SCC and DP signals which are to be inputted to the scanning electrode drive circuit 20 are synchronized with the SHS, DP, and OE signals which are to be inputted to the signal electrode drive circuit 30. Where these signals are synchronized, the scanning electrodes are selected sequentially by applying to the scanning electrodes a drive voltage having predetermined waveform corresponding to change in the level of the SI01 and S102 signals, that is, the outputs from the vertical display position adjusting circuit 58 corresponding to the result of the discrimination by the field discriminating circuit 52 which operates in response to the horizontal and vertical synchronizing signals. Furthermore, display is effected by applying to the signal electrode a voltage having a predetermined waveform synchronizing with the sequential selection as shown in FIGS. 13A–13D.

In this embodiment, the odd-numbered and even-numbered fields for the display according to the NTSC-type television are superimposed on each other and displayed on one display screen. Since one frame contains 525 H, the display period on the display screen corresponding to the odd-numbered field varies by 1 H from that corresponding to the even-numbered field.

Thus, as shown in FIGS. 13A–13D, effectively utilizing the change in the level of the SI01 and SI02 signals from the vertical display position adjusting circuit 58, the blanking period is made 4 H for the frame corresponding to the odd-numbered fields, while the blanking period is made 5 H for the frame corresponding to the even-numbered fields, thereby controlling the holding period of the frames so as to be equalized to 257 H.

As described above, according to the liquid crystal display device of the present invention, by controlling the holding period of the frame corresponding to the odd-numbered field and the holding period of the subsequent frame corresponding to the even-numbered field to be equalized, it is possible to prevent a DC voltage from being applied to the anti-ferroelectric liquid crystal medium. In this manner, burning and flickering of the display screen which are likely to occur when DC voltage is applied to the anti-ferroelectric liquid crystal medium can be prevented.

Furthermore, there is no need to convert the picture data, which effectively avoids a cost increase incidental to an enlarged scale of circuit.

Furthermore, according to the embodiment hitherto described, the display method is that of an NTSC type television; however, even when the transmission cycle of the picture data for one frame is variable, the holding period for each frame can be held constant by adjusting the blanking period, whereby the application of the DC voltage to the anti-ferroelectric liquid crystal medium can be prevented.

Furthermore, the configuration of hardware logic for each of the foregoing embodiments may be realized by software.

Furthermore, the duration of one frame, such as the duration of the blanking, selecting and holding periods, may vary depending on various conditions such as the temperature of the panel. Even in such a case, the holding period in the odd-numbered field and that in the even-numbered field in one frame can be equalized.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A matrix type liquid crystal display device comprising:

a liquid crystal panel having n scanning electrodes and m signal electrodes which are arranged in a lattice form to intersect said n scanning electrodes through an anti-ferroelectric liquid crystal medium, said n scanning electrodes, said m signal electrodes and said anti-ferroelectric liquid crystal medium constituting an anti-erroelectric liquid crystal matrix type picture element; and liquid crystal panel drive means for driving said liquid crystal panel by applying thereto a voltage with a first pattern in a first field and a voltage with a second pattern in a second field, said voltage with said second pattern having an inverse polarity to that of said voltage with said first pattern, and by repeating a frame including said first and second fields;

wherein said first and second patterns are such that all picture elements on one of said n scanning electrodes are blanked out during a first period by applying a first voltage to a corresponding scanning line, picture data is inputted to necessary picture elements on said one scanning electrode during a second period by applying a second voltage and a condition of picture elements on said one scanning electrode is maintained during a third period by applying a third voltage, said liquid crystal panel drive means includes period control means for egualizing a duration of said third period of said first pattern and a duration of said third period of said second pattern within said frame;

said duration of said first field and said duration of said second field differ within said frame; and said period control means controls at least one of said duration of said first period of said first pattern and said duration of said first period of said second pattern.

2. The device of claim 1, wherein:

said liquid crystal panel drive means includes polarity inversion means for inverting said polarity of said second voltage as said voltage of said first pattern and said polarity of said second voltage as said voltage of said second pattern; and said period control means controls said duration of said first period according to a result of said inversion of said polarity of said second voltage by said polarity inversion means.

3. A matrix type liquid crystal display device comprising:

a liquid crystal panel having n scanning electrodes and m signal electrodes which are arranged in a lattice form to intersect said n scanning electrodes through an antiferroelectric liquid crystal medium, said n scanning electrodes, said m signal electrodes and said antiferroelectric liquid crystal medium constituting an antiferroelectric liquid crystal matrix type picture element; and liquid crystal panel drive means for driving said liquid crystal panel by applying thereto a voltage with a first pattern in a first field and a voltage with a second pattern in a second field, said voltage with said second pattern having an inverse polarity to that of said voltage with said first pattern, and by repeating a frame including said first and second fields;

wherein said first and second patterns are such that all picture elements on one of said n scanning electrodes are blanked out during a first period by applying a first voltage to a corresponding scanning line, picture data is inputted to necessary picture elements on said one scanning electrode during a second period by applying a second voltage and a condition of picture elements on said one scanning electrode is maintained by applying a third voltage, said liquid crystal panel drive means includes period control means for equalizing a duration of said third period of said first pattern and a duration of said third period of said second pattern within said frame; and measuring means for measuring a cycle of a picture signal corresponding to one frame according to a horizontal synchronizing signal and a vertical synchronizing signal;

wherein said period control means is for controlling at least one of a duration of said first period of said first pattern and a duration of said first period of said second pattern responsive to said measuring means, said horizontal synchronizing signal and said vertical synchronizing signal.

4. The device of claim 3, wherein:

said liquid crystal panel drive means includes polarity inversion means for inverting said polarity of said second voltage as said voltage of said first pattern and said polarity of said second voltage as said voltage of said second pattern responsive to said measuring means and said horizontal synchronizing signal; and said period control means is for controlling said duration of said first period responsive to inversion of said polarity of said second voltage by said polarity inversion means.

5. A matrix type liquid crystal display device comprising:

a liquid crystal panel having n scanning electrodes and m signal electrodes which are arranged in a lattice form to intersect said n scanning electrodes through an antiferroelectric liquid crystal medium, said n scanning electrodes, said m signal electrodes and said antiferroelectric liquid crystal medium constituting an antiferroelectric liquid crystal matrix tone picture element; and liquid crystal panel drive means for driving said liquid crystal panel to provide a desired display by repeating, with respect to said n scanning electrodes on a time-series basis, a process during a first period in which all picture elements on one of said n scanning electrodes are blanked out by applying a first voltage to said one scanning electrode, a process during a second period in which picture data are inputted to necessary picture elements on said one scanning electrode by applying a second voltage to said one scanning electrode and said m signal electrodes, and a process during a third period in which conditions of said picture elements on said one scanning electrode are maintained by applying a third voltage to said one scanning electrode;

wherein said liquid crystal panel drive means includes period control means for keeping a duration of said third period constant;

wherein said liquid crystal panel drive means includes period control means for controlling a duration of said first period to keep said duration of said third period constant.

6. The device of claim 5, wherein:

said liquid crystal panel drive means includes polarity inversion means for inverting a polarity of said second voltage at a lapse of each odd-numbered cycle of said second period; and said period control means is for controlling said duration of said first period responsive to inversion of said polarity of said second voltage by said polarity inversion means.

7. A matrix type liquid crystal display device comprising:

a liquid crystal panel having n scanning electrodes and m signal electrodes which are arranged in a lattice form to intersect said n scanning electrodes through an antiferroelectric liquid crystal medium, said n scanning electrodes, said m signal electrodes and said antiferroelectric liquid crystal medium constituting an antiferroelectric liquid crystal matrix type picture element; and liquid crystal panel drive means for driving said liquid crystal panel to provide a desired display by reseating, with respect to said n scanning electrodes on a time-series basis, a process during a first period in which all picture elements on one of said n scanning electrodes are blanked out by applying a first voltage to said one scanning electrode, a process during a second period in which picture data are inputted to necessary picture elements on said one scanning electrode by applying a second voltage to said one scanning electrode and said m signal electrodes, and a process during a third period in which conditions of said picture elements on said one scanning electrode are maintained by applying a third voltage to said one scanning electrode;

wherein said liquid crystal panel drive means includes period control means for keeping a duration of said third period constant; and measuring means for measuring a cycle of a picture signal corresponding to one picture frame responsive to a horizontal synchronizing signal and a vertical synchronizing signal;

wherein said period control means is for controlling a duration of said first period to keep said duration of said third period responsive to said measuring means, said horizontal synchronizing signal and said vertical synchronizing signal.

8. The device of claim 7, wherein:

said liquid crystal panel drive means includes polarity inversion means for inverting a polarity of said second voltage at a lapse of each odd-numbered cycle of said second period responsive to said measuring means and said horizontal synchronizing signal; and said period control means is for controlling said duration of said first period responsive to inversion of said polarity of said second voltage by said polarity inversion means.

9. A method of driving a matrix type liquid crystal panel, said method comprising the steps of:

applying a first voltage to a scanning electrode of said panel during a first period to blank out all picture elements on said scanning electrode;

applying a second voltage to said scanning electrode and a signal electrode of said panel during a second period to actuate a pixel at an intersection of said scanning electrode and said signal electrode in accordance with picture data inputted corresponding to said scanning electrode;

applying a third voltage to said scanning electrode during a third period to maintain conditions of said picture elements on said scanning electrode;

adjusting a duration of one of said first, second and third periods to keep a duration of said third period constant; and repeating said first, second and third voltage applying steps;

wherein said adjusting step includes a step of adjusting said duration of said first period.

10. A method of driving a matrix type liquid crystal panel, said method comprising the steps of:

applying a first voltage to a scanning electrode of said panel during a first period to blank out all picture elements on said scanning electrode;

applying a second voltage to said scanning electrode and a signal electrode of said panel during a second period to actuate a pixel at an intersection of said scanning electrode and said signal electrode in accordance with picture data inputted corresponding to said scanning electrode;

applying a third voltage to said scanning electrode during a third period to maintain conditions of said picture elements on said scanning electrode;

adjusting a duration of one of said first, second and third periods to keep a duration of said third period constant;

repeating said first, second and third voltage applying steps; and inverting a polarity of said second voltage at a lapse of each odd-numbered cycle of said second period;

wherein said adjusting step includes a step of adjusting said duration of said first period responsive to inversion of said polarity of said second voltage.

11. A method of driving a matrix type liquid crystal panel, said method comprising the steps of:

applying a first voltage to a scanning electrode of said panel during a first period to blank out all picture elements on said scanning electrode;

applying a second voltage to said scanning electrode and a signal electrode of said panel during a second period to actuate a pixel at an intersection of said scanning electrode and said signal electrode in accordance with picture data inputted corresponding to said scanning electrode;

applying a third voltage to said scanning electrode during a third period to maintain conditions of said picture elements on said scanning electrode;

adjusting a duration of one of said first, second and third periods to keep a duration of said third period constant;

repeating said first, second and third voltage applying steps; and measuring a cycle of a picture signal corresponding to one picture frame responsive to a horizontal synchronizing signal and a vertical synchronizing signal;

wherein said adjusting step comprises a step of adjusting said duration of said first period to keep said duration of said third period constant responsive to said measuring step.

12. The method of claim 11, further comprising the step of:

inverting a polarity of said second voltage at a lapse of each odd-numbered cycle of said second period responsive to said measuring step;

wherein said adjusting step comprises a step of adjusting said duration of said first period responsive to inversion of said polarity of said second voltage.

13. A matrix type liquid crystal display device comprising:

a liquid crystal panel having n scanning electrodes and m signal electrodes which are arranged in a lattice form to intersect said n scanning electrodes through an antiferroelectric liquid crystal medium, said n scanning electrodes, said m signal electrodes and said antiferroelectric liquid crystal medium constituting an antiferroelectric liquid crystal matrix type picture element; and liquid crystal panel drive means for driving said liquid crystal panel by applying thereto a voltage with a first pattern in a first field and a voltage with a second pattern in a second field, said voltage with said second pattern having an inverse polarity to that of said voltage with said first pattern, and by repeating a frame including said first and second fields;

wherein said first and second patterns include a first period in which all picture elements on one of said n scanning electrodes are blanked out, a second period in which picture data is inputted to necessary picture elements on said one scanning electrode and a third period in which a condition of picture elements on said one scanning electrode is maintained by applying a third voltage having a holding voltage with predetermined polarity, said liquid crystal panel drive means includes period control means for equalizing a duration of said third period of said first pattern and a duration of said third period of said second pattern within said frame;

said duration of said first field and said duration of said second field differ within said frame; and said period control means controls at least one of said duration of said first period of said first pattern and said duration of said first period of said second pattern.

14. The device of claim 13, wherein:

said liquid crystal panel drive means includes polarity inversion means for inverting said polarity of said second voltage as said voltage of said first pattern and said polarity of said second voltage as said voltage of said second pattern; and said period control means controls said duration of said first period according to a result of said inversion of said polarity of said second voltage by said polarity inversion means.

15. A matrix type liquid crystal display device comprising:

a liquid crystal panel having n units of scanning electrodes and m signal electrodes which are arranged in a lattice form to intersect said n scanning electrodes through an anti-ferroelectric liquid crystal medium, said n scanning electrodes, said m signal electrodes and said anti-ferroelectric liquid crystal medium constituting an anti-ferroelectric liquid crystal matrix type picture element; and liquid crystal panel drive means for driving said liquid crystal panel by applying thereto a voltage with a first pattern in a first field and a voltage with a second pattern in a second field, said voltage with said second pattern having an inverse polarity to that of said voltage with said first pattern, and by repeating a frame including said first and second fields;

wherein said first and second patterns include a first period in which all picture elements on one of said n scanning electrodes are blanked out, a second period in which picture data is inputted to necessary picture elements on said one scanning electrode and a third period in which a condition of picture elements on said one scanning electrode is maintained by applying a third voltage having a holding voltage with predetermined polarity, said liquid crystal panel drive means includes period control means for equalizing a duration of said third period of said first pattern and a duration of said third period of said second pattern within said frame; and measuring means for measuring a cycle of a picture signal corresponding to one frame according to said horizontal synchronizing signal and said vertical synchronizing signal;

wherein said period control means is for controlling at least one of a duration of said first period of said first pattern and a duration of said first period of said second pattern responsive to said measuring means, said horizontal synchronizing signal and said vertical synchronizing signal.

16. The device of claim 15, wherein:

said liquid crystal panel drive means includes polarity inversion means for inverting said polarity of said second voltage as said voltage of said first pattern and said polarity of said second voltage as said voltage of said second pattern responsive to said measuring means and said horizontal synchronizing signal; and said period control means is for controlling said duration of said first period responsive to inversion of said polarity of said second voltage by said polarity inversion means.

17. A matrix type liquid crystal display device comprising:

a liquid crystal panel having n units of scanning electrodes and m signal electrodes which are arranged in a lattice form to intersect said n scanning electrodes through an anti-ferroelectric liquid crystal medium, said n scanning electrodes, said m signal electrodes and said anti-ferroelectric liquid crystal medium constituting an anti-ferroelectric liquid crystal matrix type picture element; and liquid crystal panel drive means for driving said liquid crystal panel by applying thereto a voltage with a first pattern in a first field and a voltage with a second pattern in a second field, said voltage with said second pattern having an inverse polarity to that of said voltage with said first pattern, and by repeating a frame including said first and second fields;

wherein said first and second patterns include a first period in which all picture elements on one of said n scanning electrodes are blanked out, a second period in which picture data is inputted to necessary picture elements on said one scanning electrode and a third period in which a condition of picture elements on said one scanning electrode is maintained by applying a third voltage having a holding voltage with predetermined polarity, said liquid crystal panel drive means includes period control means for equalizing a sum of a duration of said second and third periods of said first pattern and a sum of a duration of said second and third periods of said second pattern within said frame;

said duration of said first field and said duration of said second field differ within said frame; and said period control means controls at least one of said duration of said first period of said first pattern and said duration of said first period of said second pattern.

* * * * *